US008399058B2

(12) United States Patent
Eliason et al.

(10) Patent No.: US 8,399,058 B2
(45) Date of Patent: Mar. 19, 2013

(54) MASKING ARTICLE AND METHOD OF MASKING OF SUBSTRATE

(75) Inventors: Kevin M. Eliason, River Falls, WI (US); Jeffrey R. Janssen, Ho Chi Minh (VN); Larry R. Lappi, Stillwater, MN (US); Larry A. Meixner, Woodbury, MN (US); Michael J. Moszer, Forest Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 704 days.

(21) Appl. No.: 11/912,252

(22) PCT Filed: Apr. 17, 2006

(86) PCT No.: PCT/US2006/014536

§ 371 (c)(1),
(2), (4) Date: Jun. 9, 2008

(87) PCT Pub. No.: WO2006/115900

PCT Pub. Date: Nov. 2, 2006

(65) Prior Publication Data

US 2008/0248203 A1 Oct. 9, 2008

Related U.S. Application Data

(60) Provisional application No. 60/673,830, filed on Apr. 22, 2005.

(51) Int. Cl.
*B05D 1/32* (2006.01)

(52) U.S. Cl. ..... 427/281; 427/282; 427/256; 427/259; 427/272; 427/331; 428/192

(58) Field of Classification Search ..... 427/282, 427/256, 259, 272, 331, 384; 428/192
See application file for complete search history.

(56) References Cited

U.S. PATENT DOCUMENTS
(Continued)

FOREIGN PATENT DOCUMENTS

| | | |
|---|---|---|
| DE | 29601846 | 3/1996 |
| DE | 29608636 | 9/1997 |

(Continued)

OTHER PUBLICATIONS

D. Satas, Handbook of Pressure Sensitive Adhesive Technology 2nd Ed. P. 172 (1989).

(Continued)

*Primary Examiner* — Lan Vinh
*Assistant Examiner* — Maki A Angadi
(74) *Attorney, Agent, or Firm* — Philip P. Soo

(57) ABSTRACT

The present disclosure relates to a profiled masking article and method of masking a substrate to be treated or painted that provides a feathered or soft edge between painted and unpainted areas. The masking article described herein may be used as a single strip, or as multiple strips, placed side by side, wherein a strip is removed between treatments of different types. This allows successive treatment layers to completely cover previous layers, thus avoiding defects resulting from exposed layers of material. In an embodiment, the present disclosure is directed to a masking article comprising: at least one elongate body (12), said body (12) having a top surface, a bottom surface and at least two lateral surfaces, wherein at least a portion of said body comprises an adhesive material; and a generally planar top portion (14), connected to the body along at least one surface, said top portion (14) having a microstructured surface.

25 Claims, 5 Drawing Sheets

U.S. PATENT DOCUMENTS

| | | | | |
|---|---|---|---|---|
| 4,535,965 | A * | 8/1985 | Dettelbach et al. | 249/83 |
| 4,599,265 | A | 7/1986 | Esmay | |
| 4,921,740 | A * | 5/1990 | Falconer et al. | 428/41.6 |
| 5,650,215 | A | 7/1997 | Mazurek et al. | |
| 5,654,387 | A * | 8/1997 | Bennett et al. | 526/307.7 |
| 5,658,632 | A * | 8/1997 | Krabill | 428/43 |
| 6,315,851 | B1 | 11/2001 | Mazurek et al. | |
| 6,649,266 | B1 * | 11/2003 | Gross et al. | 428/410 |
| 6,824,378 | B2 * | 11/2004 | King et al. | 425/542 |
| 6,828,008 | B2 * | 12/2004 | Gruber | 428/192 |
| 2003/0194526 | A1 * | 10/2003 | Vesley et al. | 428/64.1 |

FOREIGN PATENT DOCUMENTS

| | | | |
|---|---|---|---|
| EP | 0384626 | A2 | 8/1990 |
| EP | 0 429 269 | A1 | 5/1991 |
| JP | 55-127745 | | 9/1980 |
| JP | 58-101848 | | 7/1983 |
| JP | 58-101849 | | 7/1983 |
| JP | 58-124444 | | 8/1983 |
| JP | 60-122346 | | 8/1985 |
| JP | 3-18148 | | 2/1991 |
| JP | 4-370180 | | 12/1992 |
| JP | 9-1715 | | 1/1997 |
| JP | 2003-107224 | | 4/2003 |
| WO | WO 99/46056 | | 9/1999 |
| WO | WO 00/06637 | | 2/2000 |
| WO | WO 02/068556 | A2 | 9/2002 |
| WO | WO 02/083322 | A1 | 10/2002 |
| WO | WO 03/017899 | A2 | 3/2003 |
| WO | WO 03/020439 | A2 | 3/2003 |
| WO | WO 2008/060939 | A1 | 5/2008 |

OTHER PUBLICATIONS

D. Satas, Handbook of Pressure Sensitive Adhesive Tedhhology; 2nd Ed. R 173 (1989).

* cited by examiner

MASKING ARTICLE AND METHOD OF MASKING OF SUBSTRATE

CROSS REFERENCE TO RELATED APPLICATIONS

This application is a national stage filing under 35 U.S.C. 371 of PCT/US2006/014536, filed 17 Apr. 2006, which claims priority to U.S. Provisional Application No. 60/673830, filed 22 Apr. 2005, the disclosure of which is incorporated by reference in its/their entirety herein.

TECHNICAL FIELD

The present invention relates generally to masking articles and methods of masking a substrate. The invention particularly relates to masking articles and methods of masking substrates in automotive applications.

BACKGROUND

Various masking materials used to mask or cover a surface during automotive painting operations are known. For example, conventional masking tapes or adhesive foams may be used to mask an area when applying paint to an adjacent area.

SUMMARY

In typical automotive re-painting operations, multiple coatings of paint and other materials are often used to finish a surface of a vehicle which has been repaired. For example, a common treatment used in vehicle finishing comprises an initial coating of a sealer (or primer) material, followed by a second layer of material comprising a color coating, followed by a third layer of material comprising a clear coat. It is often desirable that initial coating layers comprising the primer or sealer material be completely covered by successive coatings to avoid the appearance of a hazy, discolored band of material in the final painted surface. A painted surface containing such a defect must be sanded and/or spot painted, which adds time and cost to a repair job.

The present disclosure relates to a profiled masking article and method of masking a substrate to be treated or painted that provides a feathered or soft edge between painted and unpainted areas. The masking article described herein may be used as a single strip, or as multiple strips, placed side by side, wherein a strip is removed between treatments of different types. This allows successive treatment layers to completely cover previous layers, thus avoiding defects resulting from exposed layers of material.

In an embodiment, the present disclosure is directed to a masking article comprising:

at least one elongate body, said body having a top surface, a bottom surface and at least two lateral surfaces, wherein at least a portion of said body comprises an adhesive material; and a generally planar top portion connected to the body along at least one surface, said top portion having a microstructured surface.

In a further embodiment, the present disclosure is directed to a masking article comprising an elongate body, said body having a top surface, a bottom surface and at least two lateral surfaces, wherein at least a portion of said body comprises an adhesive material made by a casting process; and a top portion connected to the body along at least one surface.

In yet another embodiment, the present disclosure is directed to a method of masking a substrate having a surface to be masked and a surface to be treated comprising applying at least one masking article to the substrate, said article comprising an elongate body, said body having a top surface a bottom surface and at least two lateral surfaces, said body further comprising an adhesive, and a generally planar top portion connected to the body along at least one surface, applying a first coating of material on the substrate; removing said at least one masking article from the substrate; and applying a second coating of material to the substrate.

In a further embodiment, the present disclosure is directed to method of making a masking article comprising: (a) applying an adhesive material to a cavity of a casting tool; (b) applying a sheet of material over the adhesive material; and (c) removing the adhesive material together with the sheet of material from the casting tool, to form a masking material having at least one segment of adhesive material attached to the sheet of material.

A "Pressure Sensitive Adhesive (PSA)" as used herein, is an adhesive that is aggressively and permanently tacky and will firmly adhere to a wide variety of dissimilar surfaces upon mere contact and without the need for more than finger or hand pressure. A PSA requires no activation by water, solvent or heat in order to exert a strong adhesive holding force toward materials such as paper, glass, plastic, wood, cement and metals.

PSAs typically include materials (e.g., elastomers) that are either inherently tacky or that are tackified with the addition of tackifying resins. They can be defined by the Dahlquist criteria described in Handbook of Pressure Sensitive Adhesive Technology, D. Satas, $2^{nd}$ ed., page 172 (1989) at use temperatures. This criterion defines a good PSA as one having a 1 second creep compliance of greater than $1\times10^{-6}$ $cm^2$/dyne. Alternatively, since modulus is, to a first approximation, the inverse of compliance, PSAs may be defined as adhesives having a modulus of less than $1\times10^6$ dynes/$cm^2$.

Another suitable definition of a PSA is an adhesive that has a room temperature storage modulus within the area defined by the following points as plotted on a graph of modulus versus frequency at 25° C.: a range of moduli from approximately $2\times10^5$ to $4\times10^5$ dynes/$cm^2$ at a frequency of approximately 0.1 radian/second (0.017 Hz), and a range of moduli from approximately $2\times10^6$to $8\times10^6$ dynes/$cm^2$ at a frequency of approximately 100 radians/second (17 Hz) (for example, see FIGS. 8-16 on p. 173 Handbook of Pressure Sensitive Adhesive Technology, D. Satas, $2^{nd}$ ed., (1989)).

Other methods of identifying a pressure sensitive adhesive are also known. Any of these methods of identifying a pressure sensitive adhesive may be used to identify suitable pressure sensitive adhesives of the present disclosure.

DETAILED DESCRIPTION

The present disclosure relates to a profiled masking article and method of masking a substrate to be treated or painted that provides a feathered or soft edge between painted and unpainted areas. The masking article described herein may be used as a single strip, or as multiple strips, placed side by side, wherein a strip is removed between treatments of different types. This allows successive treatment layers to completely cover previous layers.

While the masking articles described herein may be used in any masking operation, the masking articles are particularly well suited for masking the gaps between adjacent panels of an automobile, such as a door jamb.

Figure 1A:
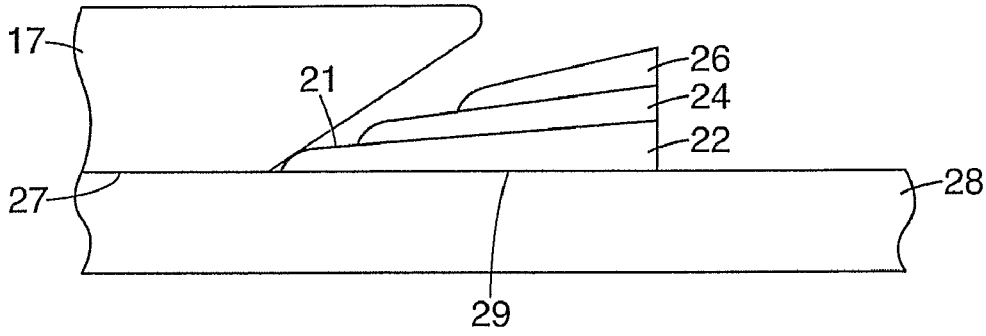
Fig. 1a PRIOR ART
FIG. 1*a* is a side view of a prior art masking material.

A typical procedure used in automotive repair operations to treat a substrate such as a surface of a vehicle to be partially painted, includes applying an initial coating of a primer/sealer to the substrate, followed by a color coating (or paint layer), followed by a clear coat layer. Turning now to FIG. 1*a*, a prior art masking method is depicted wherein the use of a single piece of masking material 17 used to mask a substrate 28 results in the first primer/sealer layer 22 penetrating furthest in toward the masking material, with each subsequently applied layer (24 and 26) penetrating to a lesser extent. The result is that a peripheral edge of the primer/sealer layer 21 is left uncovered by subsequent treatment layers, which results in a hazy, flawed appearance. In order to obtain a smooth finished or "feathered" edge, the surface must be sanded down and/or repainted which substantially adds to repair time and labor.

Figure 1B:
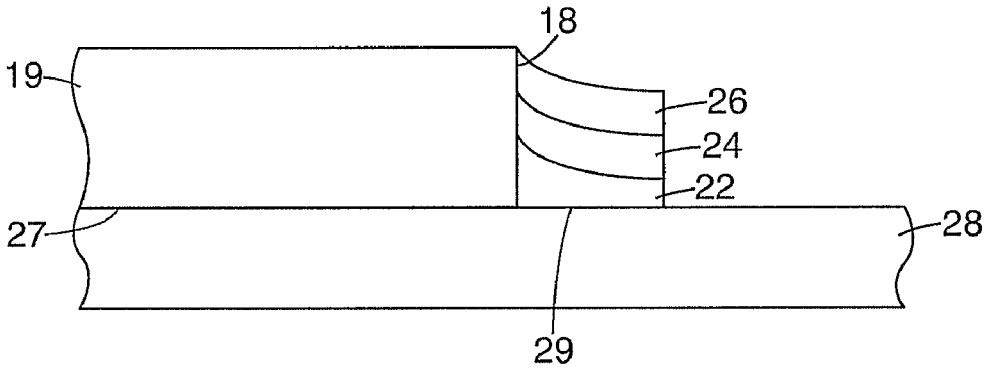
Fig. 1b PRIOR ART
FIG. 1*b* is a side view of a prior art masking material.

FIG. 1*b* illustrates the coating profile obtained when the layers of primer/sealer 22, color coat 24, and clear coat 26, are applied to a substrate to be painted 28, when masked with conventional masking tape 19. The use of conventional masking tape 19 results in a high edge profile or meniscus 18, which typically must be sanded and repainted to achieve a smooth finish.

Figure 2:
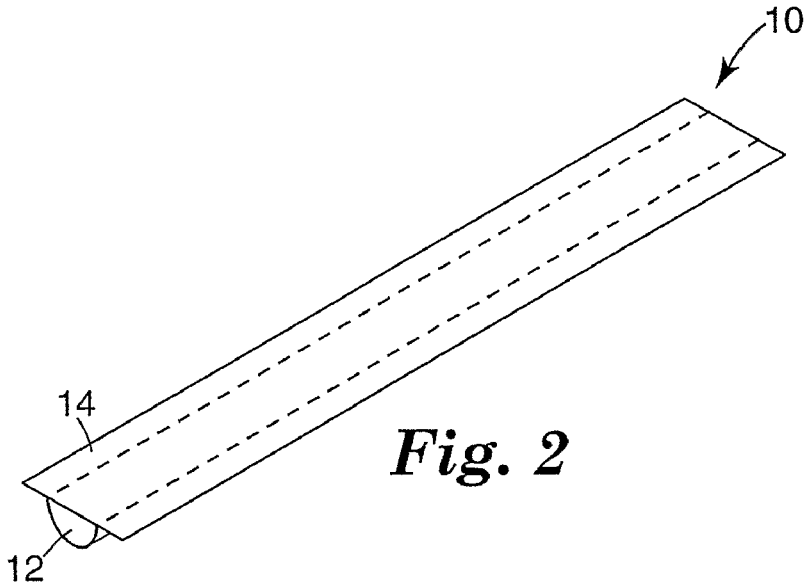
FIG. 2 is a perspective view of a masking article of the present disclosure.

Turing now to FIG. 2, a perspective view of a masking article according to one embodiment of the disclosure is shown. Masking article 10 has a generally elongate body portion 12 and a top portion 14 attached to a surface of the body portion 12.

In an embodiment, the body portion 12 of the masking article is made, at least in part, of an adhesive material. In a further embodiment, the body portion 12 is made entirely of an adhesive material and formed by any number of suitable processes, including a casting process, hot melt process and the like.

As may be appreciated by one skilled in the art, the body portion of the masking article may take on a variety of suitable shapes including, but not limited to polygonal shapes such as square, rectangular, triangular, and pentagonal. Suitable shapes also include shapes having curved or arcuate surfaces, including, but not limited to circular, oval, and elliptical shapes. Suitable shapes additionally include shapes having both arcuate portions and non-arcuate portions, such as, by way of non-limiting example, parabolic, or obround shapes.

Figure 3A:
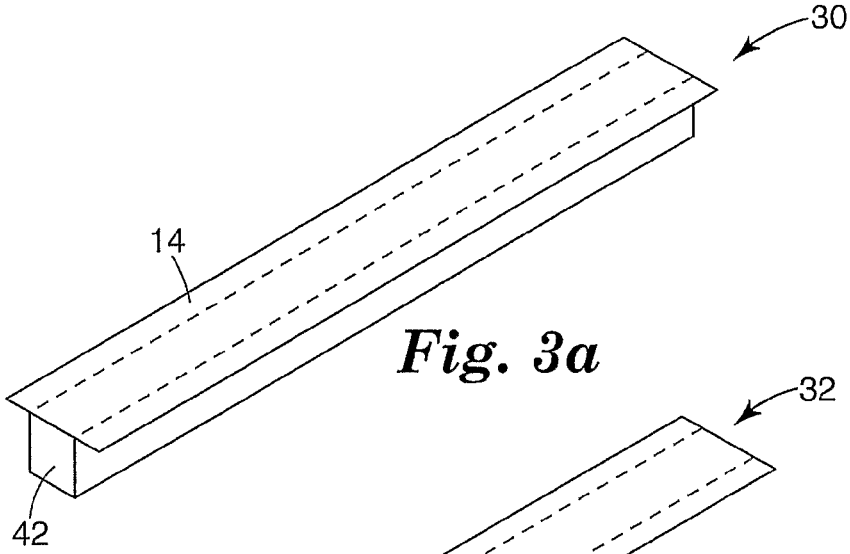
FIG. 3*a* is a perspective view of a masking article of the present disclosure.
Figure 3B:
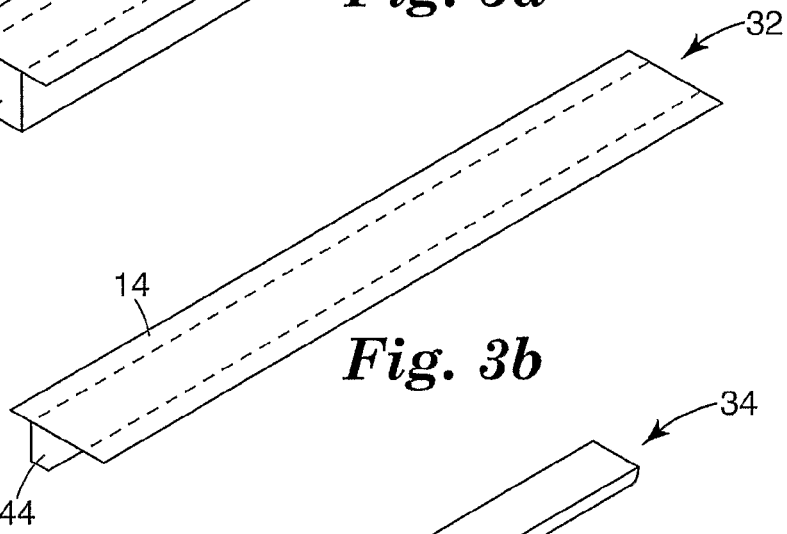
FIG. 3*b* is a perspective view of a masking article of the present disclosure.
Figure 3C:
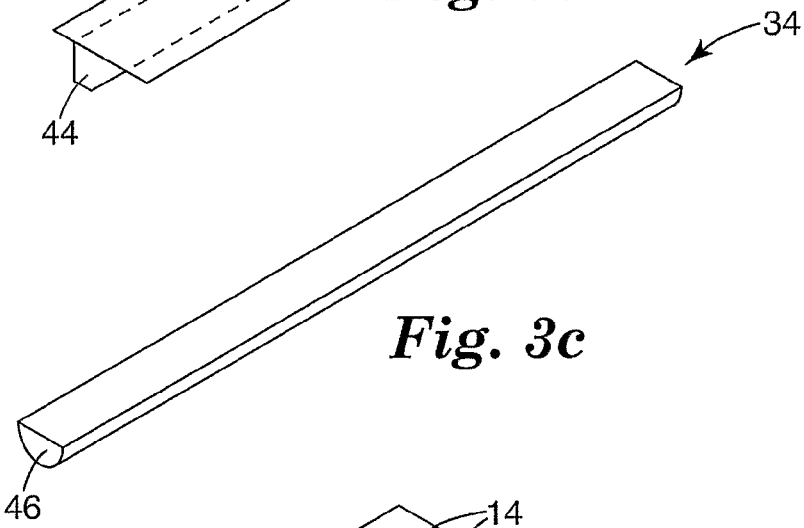
FIG. 3*c* is a perspective view of a masking article of the present disclosure.

Turning now to FIG. 3, alternate embodiments of masking articles are shown. FIG. 3*a* shows masking article 30 having a body portion 42 with a square cross-section. Masking article 32 is shown in FIG. 3*b* with body portion 44 having a trapezoidal cross-sectional FIG. 3*c* shows a masking article 34 having a body portion 46 with a parabolic cross-sectional shape, and no top portion. It should further be appreciated that the cross-sectional shape of an elongate masking article may have more than one cross-sectional shape along its length.

In an embodiment, the top portion 14 of the masking article is generally planar, however, it should be appreciated that the top portion may take the form of any number of suitable shapes, for example, the top portion may be formed to follow the contour of the body portion, or may take the form an any suitable shape, by way of non-limiting example, concave, convex, or corrugated.

The top portion may be made of any suitable material. In an embodiment, the top portion 14 is made of a thermoplastic material, which is either laminated or formed as an integral piece with the body portion 12. In some embodiments, top portion 14 contains a microstructured surface. Alternatively, the masking article may be configured without a top portion (see FIG. 3*c*). In such a configuration, a surface of body portion would be provided without adhesive to enable the user to adhere the article to a surface to be treated.

In an embodiment including a top portion 14 having a microstructured surface, the presence of the microstructured surface could enable the masking article to be wound directly upon itself for storage and shipment without the use of a release liner.

A microstructured surface as used herein, is defined as a surface having three dimensional surface features. A microreplicated surface as used herein, is defined as a type of microstructured surface made by impressing or casting the surface features with a tooled surface having a negative impression of the microreplicated pattern. A microstructured surface may be made by a tool such as those described by U.S. Pat. No. 6,824,378 (King et al.). Types of microstructured surfaces include, but are not limited to, pyramids, grooves, cones, prisms, spheres, and ellipsoids. Various micro structured surfaces are described in U.S. Pat. No. 6,315,851 (Mazurek et al.). In an embodiment, the top surface of the masking article comprises a cross-hatched pattern of grooves.

Materials suitable for making the top portion of the masking article include a broad range of natural and synthetic materials. Examples of such materials include, but are not limited to, polyolefins such as polyethylene, polypropylene, polybutene, or polypentene; polyesters such as polyethylene terephthalate, polybutylene terephthalate, or polyethylene naphthalate; polyamides, polythioethers, polysulfones, polyurethanes, polyethersulfones, polyimides, polyvinylalcohols, polyvinylchloride, and combinations of these.

In an embodiment, the dimensions of the masking articles are about 3/16-inch (4.76 mm) wide by about 25 mils (0.64 mm) thick. The length of the articles may vary depending on the application, and may be provided in pre-cut segments separable by a line of weakness, perforation, or other suitable means.

Materials suitable for making the body portion of the masking articles described herein include a broad range of natural and synthetic materials. In some embodiments, the body portion of the masking material is made entirely of a pressure-sensitive adhesive material. In other embodiments, the body portion is primarily composed of a non-adhesive material, with a layer of PSA material to adhere the article to a substrate. Examples of suitable pressure-sensitive adhesive materials include, but are not limited to, polyolefins, acrylate polymers, natural and synthetic rubbers, silicone polymers, polyurethanes, poly (vinyl ethers), and styrene block copolymers. The PSA material may be inherently tacky, or takifiers may be added to the base material to form the PSA. Useful tackifiers include, for example, rosin ester resins, aromatic hydrocarbon resins, aliphatic hydrocarbon resins, and terpene resins. Other materials can be added for special purposes, including, for example, oils, plasticizers, antioxidants, ultraviolet ("UV") stabilizers, hydrogenated butyl rubber, pigments, and curing agents. Further disclosures of useful PSAs may be found in WO 2003017899 A and U.S. Pat. No. 5,654,387, the entire disclosures of which are incorporated by reference herein.

The PSA material may further contain elastomeric or rigid microspheres such as those described in WO 00/06637.

Although a variety of PSA materials would be suitable for use in the present invention, it is preferable that the PSA material used creates minimal adhesion buildup after being applied to a substrate, even after exposure to elevated temperatures. It is desirable for the adhesive material used to peel cleanly from the substrate without either delaminating the substrate or leaving an adhesive residue. Also, this characteristic assists in the ability of the masking material to be wound upon itself without the need for a release liner. One method of making such an adhesive is to cure or cross-link the adhesive material before it is used, as further described below. Other methods are described in U.S. Pat. No. 4,599,265, the entire disclosure of which is incorporated by reference herein.

The masking articles described herein may be made by any number of processes such as extrusion, injection molding, die-casting or other suitable processes for molding or forming an article. In an embodiment, masking articles as described herein are made by extruding the body portion onto a web of material, which forms the top portion of the masking article. In this embodiment, several body portions may be extruded in parallel onto a web of material, with individual articles subsequently cut from the larger web, for example, by a roll converting process. Alternatively, both the top portion and body portion of the masking article may be formed simultaneously by an extrusion or co-extrusion process. In a further embodiment, the top portion of the masking article may be laminated onto the extruded body portion of the masking article.

In an embodiment, the body portion of the masking article is made by a casting process as described in U.S. Patent Publication No. 2003/0194526, the entire disclosure of which is incorporated by reference herein. The process provides for the continuous production of viscoelastic articles, such as pressure-sensitive adhesives, in which a composition that is curable to a viscoelastic material is coated onto a first release surface of a production tool wherein the first release surface is reusable and configured to permit continuous production of the material. A substrate including a second release surface is contacted with the viscoelastic material that has been coated on to the first release surface. The viscoelastic material may be partially or completely cured while in contact with the first and second release surfaces. In an embodiment, the second release surface is a sheet of material making up the top portion of the masking articles.

Suitable configurations for the production tool include, for example, a belt, a drum or a roller. The production tool may be constructed from a release material in order to provide sufficient release characteristics such that it can promote the release of material from the tool. Suitable release materials include, but are not limited to, silicone and fluorocarbon polymers. Alternatively, the tool may be constructed of any suitably supportive material and then coated with a release coating in order to provide the first release surface. Suitable release coatings include, but are not limited to, silicone and fluorocarbon polymers.

The release surface of the production tool may be smooth or may include a structured surface such as a micro- or macro-replicated pattern. The surface may include any suitable structured surface, patterned or unpatterned. Suitable structured surfaces include, but are not limited to, wells, pockets, ridges, channels and the like. Any structure of the surface will be the negative image of the structured surface desired on the article. For example, ridges on the reusable surface will manifest as channels in a surface of the article.

Another suitable manufacturing process is where a porous mold is created. The mold is created from a mixture of glass beads and a powdered epoxy resin. The glass beads and epoxy are mixed together and placed over a male tool. Heat and pressure are applied to flow the epoxy resin and to cure it. The ratio of epoxy to glass beads is selected so the resultant mold is dimensionally stable, yet porous. A release film is applied to the surface of the mold (optionally with heat) and a vacuum is applied through the mold and the release sheet conforms to the mold cavity. The release sheet could be a formable sheet coated with a release layer such as a silicone. The PSA composition is applied to the formed release sheet in the mold. The top portion of the masking article is applied to the PSA and the PSA is cured via a thermal process or by actinic radiation.

In an embodiment, the viscoelastic material which makes up the body portion of the masking article is partially cured while in contact with the first release surface and subsequently brought into contact with a sheet of material comprising the top portion of the masking article. The body portion may then be filly cured. To facilitate curing of the adhesive material, the sheet of material may be transparent or translucent. This method of assembly as advantageous as the partially cured material is tacky and promotes adhesion between the viscoelastic material and the sheet of material comprising the top portion of the masking article. In this way, an additional adhesive need not be used to adhere the sheet of material comprising the top portion of the masking article to the body portions.

In this embodiment, the sheet of material comprising the top portion of the masking article acts as a second release surface. To ensure successful transfer of the body portion onto the material comprising the top portion of the masking article, the first release surface (or production tool) has a surface energy that is lower than the surface energy of the second release surface. The cured composition will, therefore, preferentially adhere to the sheet of material when the sheet of material is separated from the first release surface.

The curable composition may be cured by an energy source using any suitable curing means including, but not limited to, heat, infrared, ultraviolet, visible or electron beam radiation. Infrared radiation, as used herein, refers to non-particulate radiation having a wavelength within the range of about 800 nanometers to about 3 millimeters. Ultraviolet radiation, as used herein, refers to non-particulate radiation having a wavelength within the range of about 200 to about 400 nanometers. Visible radiation, as used herein, refers to non-particulate radiation having a wavelength within the range of about 400 to about 800 nanometers. Electron beam radiation has a dosage within the range of about 0.1 to about 10 Mrad.

The rate of curing at a given level of radiation may vary according to the transmissive properties of the material comprising the top portion of the masking article as well as the density, temperature, and nature of the curable composition. It may be possible to control curing so that the surface of the curable composition that is in contact with the material comprising the top portion of the masking article is cured to a greater extent than the curable composition that is in contact with the production tool. Such control of curing may provide the cured composition with release characteristics desirable for a particular application because, generally, a partially cured composition may be more easily removed from a release surface than a completely cured composition.

Figure 4:
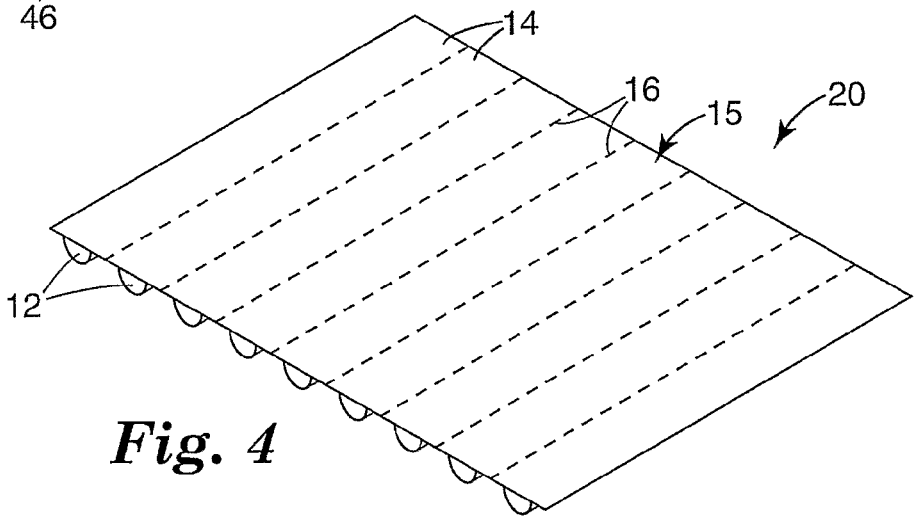
FIG. 4 is a perspective view of several masking articles of the present disclosure.

Turning now to FIG. 4, several masking articles 20 are shown in perspective view as they might emerge from a first release surface of a production tool, with adjacent top portions 14 of each article attached via perforations 16 or other means known in the art. In use, one or more strips of the masking material may be held together via perforations or other means 16 in order to ensure proper alignment on the article to be masked.

Figure 11:
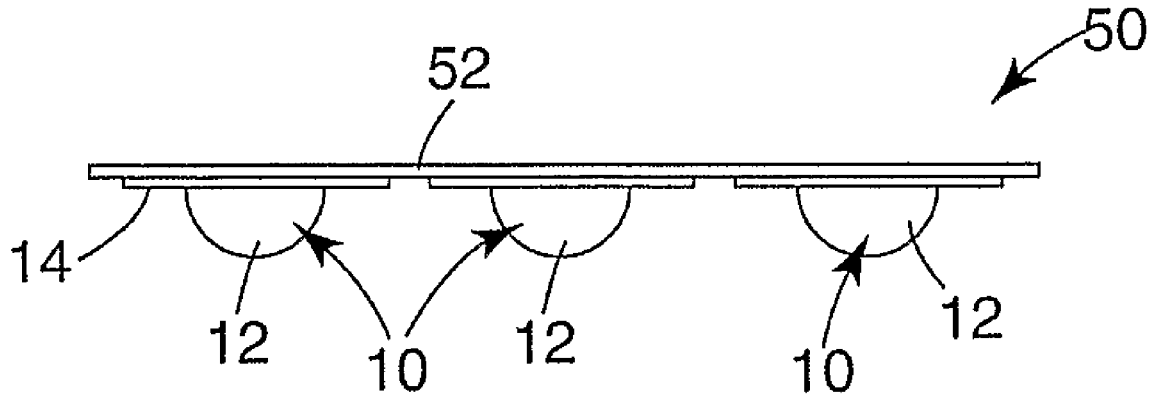
FIG. 11 is a side view of a of several masking articles of the present disclosure.

Alternatively, masking articles may be provided as depicted in FIG. 11 with individual masking articles 10 held together by a pre-mask tape 52. The pre-mask tape is a material with very low adhesion such that when the body portions of the masking articles are adhered to a substrate, the pre-mask tape is easily removed.

In an embodiment, the sheet of material 15 is laminated onto a surface of segments of material making up the body portions 12. Ideally the segments of material making up the body portions 12 are partially cured when they are brought into contact with the sheet of material 15. Once the sheet of material 15 is laminated onto the segments of material making up the body portions 12 of the masking articles, the body portions are fully cured. Upon curing, the body portions 12 of the masking article are adhered to sheet of material 15. At this point, the sheet of material 15 may be cut or scored along lines 16 to produce individual making articles 10 with top portions 14 and body portions 12. Alternatively, the sheet of material may be cut such that two or more body portions 12 are held together.

Figure 5:
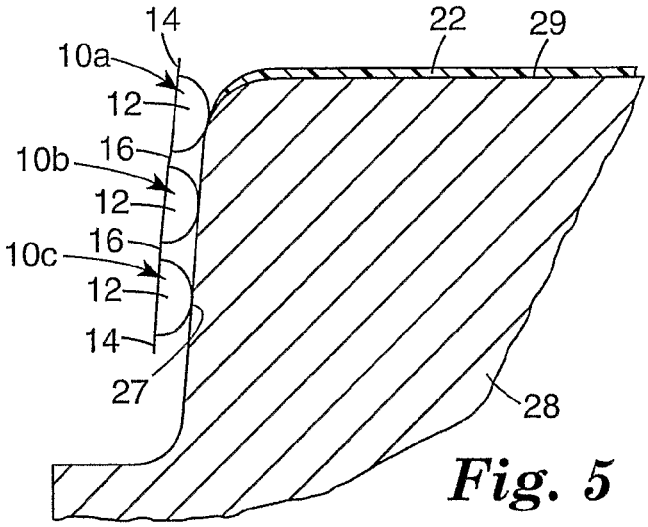
FIGS. 5-10 depict various masking articles masking a substrate.
Figure 6:
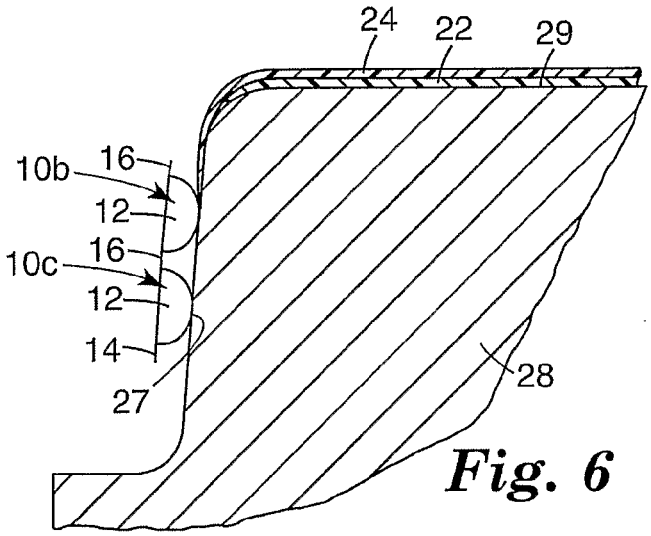
Figure 7:
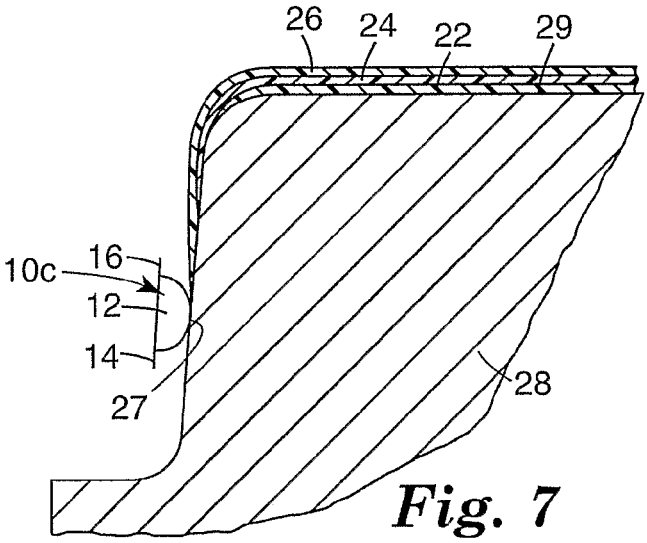

The present disclosure is also directed to a method of masking a substrate having a surface to be masked and a surface to be treated or painted. Turning now to FIG. 5, a substrate 28 is shown, having a surface to be masked 27 and a surface to be treated 29. Several masking articles 10*a*, 10*b*, and 10*c* are shown in side view with body portions 12 adhered to the surface of the substrate to be masked 27. The top portions 14 of the masking articles 10*a*, 10*b*, and 10*c* are held together via perforations 16, lines of weakness, or other suitable means known in the art. A first layer of paint or other treatment 22 is applied to the surface of the substrate to be treated 29. In an embodiment, the first layer of treatment is a primer or sealant material. When applied, the first treatment layer 22 penetrates into the leading edge of the body portion 12 of the first masking article 10*a*. The first 22 and subsequent treatment layers (24, 26) may be dried, as appropriate, before applying the next layer.

After the first treatment layer 22 is applied, the first masking article 10*a* is removed along the first line of perforation 16 (or line of weakness) connecting masking articles 10*a* and 10*b*. Next, the second treatment layer 24 is applied to the substrate 28 over the first treatment layer 22. The second treatment layer 24, penetrates into the leading edge of the body portion 12 of the second masking article 10*b*, thus completely covering the first treatment layer 22. In an embodiment, the second treatment layer 24 is a paint material.

After the second treatment layer 24 is applied, the second masking article 10*b* is removed along a second line of perforation 16 (or line of weakness) connecting masking articles 10*b* and 10*c*. Next, the third treatment layer 26 is applied to the substrate over the second treatment layer 24. The third treatment layer 26, penetrates into the leading edge of the body portion 12 of the second masking article 10*c*, thus completely covering the second treatment layer 24. In an embodiment, the third treatment layer 24 is a clear coat material.

As one skilled in the art may appreciate, any number of treatment layers may be applied to a substrate according to the method described herein, using one or more masking articles placed in parallel, which are sequentially removed after each treatment layer is applied.

Figure 8:
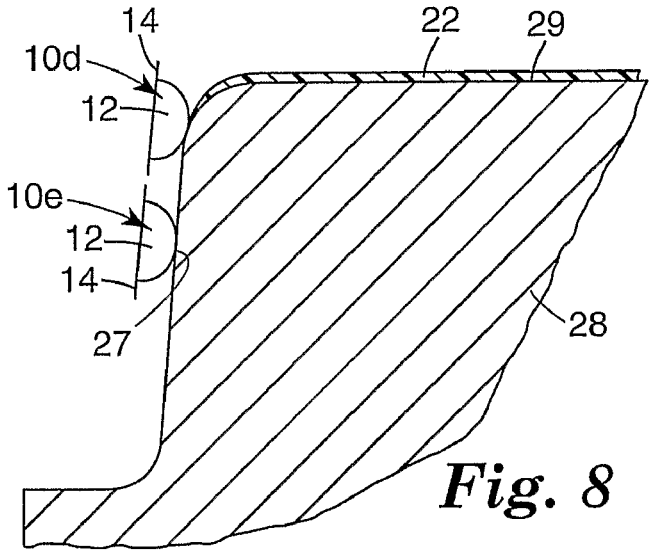
Figure 9:
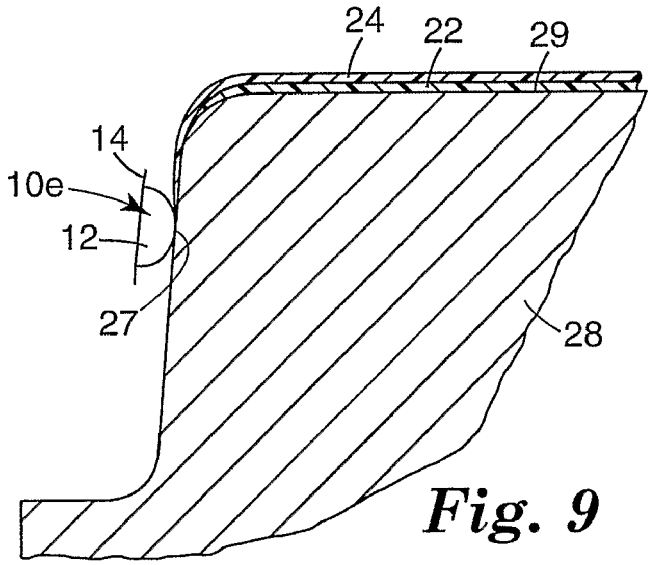

FIGS. 8 and 9 depict individual masking articles 10*e* and 10*d*, which are provided with top portions 14 unattached, applied to a substrate 28. Masking articles thus provided may be used in the same manner as articles connected via lines of weakness or perforations. Alternatively, masking articles could be provided as shown in FIG. 11, with several masking articles 10 held together by a pre-mask tape which would allow the user to position the masking articles on the substrate. Once the pre-mask is removed, the individual masking articles may be easily removed from the substrate.

Figure 10:
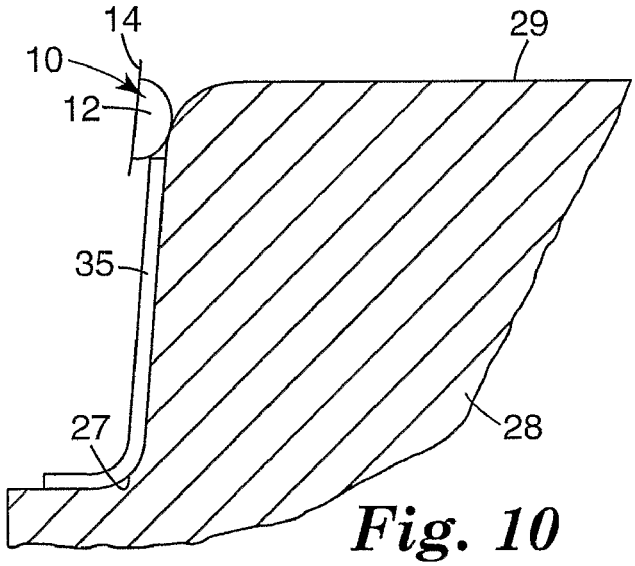

As may be appreciated by one skilled in the art, masking articles 10 of the present disclosure may be used in conjunction with other masking articles, as depicted in FIG. 10. FIG. 10 shows masking article 10 applied to a substrate 28, along with a further masking article 35. The additional masking article 35 may assist in preventing paint or other treatments from coating the substrate beyond areas to be treated.

EXAMPLES

Unless otherwise noted, all parts, percentages, and ratios reported in the following examples are on a weight basis, and all reagents used in the examples were obtained, or are available, from general chemical suppliers such as the Sigma-Aldrich Chemical Company, Saint Louis, Mo., or may be synthesized by conventional techniques.

The following abbreviations are used in the following Examples:

"PEF1": a cast 5 mil (127 micrometers) low density polyethylene film, one side having a microreplicated cross-hatch pattern of ridges, approximately 2 mil (51 micrometers) high, spaced 8 mil (203 micrometers) apart and 3 mil (76 micrometers) high;

"PEM1": pre-expanded microspheres, commercially available under the trade designation "Expancel DE 091" from Expancel, Inc., Duluth, Ga.;

"PPF1": a cast 5 mil (127 micrometers) polypropylene film, having a microreplicated surface the same as PEF1;

"PI1": 2,2-dimethoxy-2-phenylacetophenone, commercially available under the trade designation "Irgacure 651" from Ciba Specialty Chemicals, Hawthorne, N.Y.;

"PI2": 2,6-bis(trichloromethyl)-6-(4-methoxyphenyl)-1,3,5-triazine, CAS No. 3584-23-4;

"SIL1": a 2-part silicone resin, commercially available under the trade designation "Silastic J" from Dow Chemical Company, Midland, Mich.;

"MON1": isooctylacrylate monomer, made by esterification of isooctyl alcohol with acrylic acid;

"MON2": acrylic acid, commercially available from Sigma-Aldrich Company;

"SIL2": a solvent based, tin catalyzed, silicone commercially available under the trade designation "Syloff 292" from Dow Chemical Company.

Example 1

A silicone casting tool was prepared as follows. A flexographic printing plate, 6-inch×12-inch (15.2×30.5 cm), having parallel trapezoidal grooves in a down web direction, ⅛-inch (3.2 mm) wide by 25 mils (0.64 mm) deep, spaced 3/16-inch (4.8 mm) center-to-center, with sidewalls tapered outward at an angle of 15°, was taped to a supporting glass plate. SIL1 was applied to the printing plate at 20° C., smoothed out using a spatula and degassed by placing the assembly in a vacuum chamber for 10 minutes. Edge dams were used to prevent lateral flow of SIL1 beyond the printing plate. The assembly was then removed from the vacuum chamber and the silicone allowed to cure at 20° C. for 24 hours. The resulting silicone casting tool was removed from the printing plate, dipped into a release coating of SIL2, excess release coating was shaken off, after which the casting tool dried in an oven set to 250° F. (121° C.) for 3 minutes.

A 96/4 by weight mixture of MON1/MON2 containing 0.04% by weight PI1 was degassed with a stream of nitrogen, then partially cured at 20° C. to a viscosity of 4100 cps (4.1 Pascal.sec), using a blacklight, type "F20T8 350 BLB", obtained from Osram Sylvania Company, Danvers, Mass. An additional 0.16% by weight PI1 and 0.15% by weight PI2 were added, mixed by hand until homogeneous, and the partially cured composition applied to the surface of the silicone casting tool. A sheet of PPF1 was then laid, smooth side down, over the partially cured composition. A squeegee was applied over the film to spread the partially cured composition, remove air bubbles and to force the partially cured composition into the silicone casting tool. A 5 mm thick quartz glass plate then was placed over the PPF1 and the composition exposed to two blacklights, type "F15T8BL" from General Electric Company, Louisville, Ky., for 20 minutes at a distance of 5 cm. The resultant gelled adhesive, along with the supporting film, was removed from the silicone casting tool and further cured by exposing, adhesive side up, in a nitrogen purged chamber, under the same blacklight conditions. The resulting cast adhesive was slit between the adhesive bands, into individual elongate strips, the strips were then spliced together and wound into a roll on a 3-inch (7.6 cm) core. The microreplicated surface of the supporting polypropylene film thus functioned as a release surface.

Example 2

A sheet of cast adhesive was made according to the method described in Example 1, except that, prior to splicing, a premask tape, commercially available under the trade designation "SCPA Premasking Tape" from 3M Company, St. Paul, Minn., was laminated, to the back side of the slit strips of cast adhesive. Whilst still in register, the premask tape was then slit between every third strip of the underlying cast adhesive. The three-strip masking material was applied to the inside of a vertically positioned cold rolled steel doorjamb test panel, obtained from ACT Laboratories, Hillsdale, Mich., and the premask tape removed. A sealer, "Deltron NCS 2004 Gray Sealer", obtained from PPG Industries, Pittsburgh, Pa., was sprayed into the door jamb test panel and allowed to dry for 30 minutes. The first elongate strip was removed and two layers of basecoat, "Deltron DBU Pewter Basecoat", obtained from PPG Industries, were sprayed into the door jamb panel, 10 minutes apart, and allowed to dry for 15 minutes. A clearcoat, "Concept DCU 2021 Clearcoat", also obtained from PPG Industries, was then sprayed into the doorjamb panel and allowed to dry for 15 minutes. The second elongate strip was removed and a second layer of the clearcoat sprayed into the door jamb panel. The panel was allowed to dry for 2 hours, after which the third elongate strip was removed to reveal a smooth, feathered, painted doorjamb.

Example 3

A roll of cast adhesive was made according to the method described in Example 1, except the support film PPF1 was replaced with PEF1.

Example 4

A roll of cast adhesive was made according to the method described in Example 1, except the trapezoidal profile of the flexographic printing plate was replaced with an aluminum plate machined with grooves of a cylindrical cross-section defined by a 1/16-inch (1.6 mm) radius and a chord 40 mil (1.02 mm) from the edge of the cylinder on 3/16 inch centers. An intermediate replication step with a cast urethane (Durothane S-800, from Synair, Chattanooga, Tenn.) was required to get the appropriate surface topography on the silicone casting tool. Three strips of this material were used as masking tape according to the method described in Example 2, resulting in a smooth, feathered painted door jamb.

Example 5

A roll of cast adhesive was made according to the method described in Example 4, except the cylindrical cross-section had a radius of 1/8-inch (3.2 mm) and no land area between sections (chords). Three strips of this material were used as masking tape according to the method described in Example 2, resulting in a smooth, feathered painted door jamb.

Example 6

A roll of cast adhesive was made according to the method described in Example 1, except that, using a shear blade type mixer, 0.5% by weight of PEM1 was dispersed into to the partially cured composition before applying it to the silicone casting tool. The partially cured composition was subjected to vacuum in a desiccator to remove entrained air before it was applied to the silicone casting tool.

Example 7

Sheets of cast adhesive were made according to the method described in Example 1, except the backside of the polypropylene film was corona treated using a hand-held wand, model "Dyna-A-Mite" from Enercon Industries Corporation, Menomonee Falls, Wis. Two sheets of cast adhesive strips were stacked between two flat plates and weighted at 50 grams/cm$^2$ for 4 weeks at 20° C. Following this simulated storage regimen the two layers of cast adhesive were readily peeled apart.

What is claimed is:

1. A masking article comprising:

at least one elongate body, said body having a generally planar top surface, a bottom surface and at least two lateral surfaces, wherein the bottom surface of said body comprises an adhesive material; and a generally planar top portion overhanging the body and connected to the body along said top surface, said top portion having a microstructured surface.

2. The masking article of claim 1, wherein the body has cross-sectional shape having an arcuate surface.

3. The masking article of claim 2, wherein the body has a parabolic cross-section.

4. The masking article of claim 1, wherein said body is made entirely of an adhesive.

5. The masking article of claim 1, wherein said top portion is made of a material taken from the group consisting of a polyolefin, polyester, and a polyamide.

6. The masking article of claim 5, wherein said top portion is made from polypropylene.

7. The masking article of claim 1, wherein said body is made of a material taken from the group consisting of acrylate polymers, natural and synthetic rubbers, silicone polymers, polyurethanes, polyolefins, and poly (vinyl ethers).

8. The masking article of claim 7, wherein said body is made from an acrylate polymer.

9. The masking article of claim 1, wherein said body is cured.

10. The masking article of claim 1, wherein the adhesive is a pressure sensitive adhesive.

11. A masking article comprising:

an elongate body, said body having a generally planar top surface, a bottom surface and at least two lateral surfaces, wherein the bottom surface of said body comprises an adhesive material made by a casting process; and a top portion overhanging the body and connected to the body along said top surface wherein said top portion further comprises a microstructured surface.

12. The masking article of claim 11, wherein the body has a parabolic cross-section.

13. The masking article of claim 11, wherein the microstructured surface comprises a cross-hatch pattern.

14. The masking article of claim 11, wherein said top portion is made of a material taken from the group consisting of a polyolefin, polyester, and a polyamide.

15. The masking article of claim 14, wherein said top portion is made from polypropylene.

16. The masking article of claim 11, wherein said body is made of a material taken from the group consisting of acrylate polymers, natural and synthetic rubbers, silicone polymers, polyurethanes, polyolefins, and poly (vinyl ethers).

17. The masking article of claim 16, wherein said body is made from an acrylate polymer.

18. The masking article of claim 11, wherein said body is cured.

19. The masking article of claim 11, wherein the adhesive is a pressure sensitive adhesive.

20. A method of masking a substrate having a surface to be masked and a surface to be treated comprising:

applying at least one masking article to the substrate, said article comprising an elongate body, said body having a generally planar top surface a bottom surface and at least two lateral surfaces, said body further comprising an adhesive, and a generally planar top portion overhanging the body and connected to the body along said top surface;

applying a first coating of material on the substrate;

removing said at least one masking article from the substrate; and applying a second coating of material to the substrate.

21. The method of claim 20, further comprising: applying a second masking article to the substrate, adjacent the first masking article.

22. The method of claim 21, further comprising the steps of: (i) removing the second masking article after applying the second coating of material on the substrate; and (ii) applying a third coating of material to the substrate.

23. The method of claim 20, wherein said body is made entirely of an adhesive.

24. The method of claim 23, wherein said body is made of a material taken from the group consisting of acrylate polymers, natural and synthetic rubbers, silicone polymers, polyurethanes, polyolefins, and poly (vinyl ethers).

25. The method of claim 23, wherein said body is made of an acrylate polymer.

* * * * *

UNITED STATES PATENT AND TRADEMARK OFFICE

CERTIFICATE OF CORRECTION

PATENT NO. : 8,399,058 B2
APPLICATION NO. : 11/912252
DATED : March 19, 2013
INVENTOR(S) : Kevin M Eliason It is certified that error appears in the above-identified patent and that said Letters Patent is hereby corrected as shown below:

Title Page, Column 2 (Other Publications)
Line 1, Delete “Technology” and insert -- Technology, --, therefor.

Title Page 2, Column 2 (Other Publications)
Line 1, Delete “Tedhhology;” and insert -- Technology, --, therefor.
Line 2, Delete “R” and insert -- P. --, therefor.

In the Specifications

Column 2
Line 43, Delete “$2\times10^6$to” and insert -- $2\times10^6$ to --, therefor.

Column 3
Line 1, Delete “a of” and insert -- a --, therefor.
Line 65, Delete “sectional” and insert -- section. --, therefor.

Column 4
Line 63, Delete “takifiers” and insert -- tackifiers --, therefor.

Column 6
Line 27, Delete “filly” and insert -- fully --, therefor.

Column 9
Line 46, Delete “doorjamb” and insert -- door jamb --, therefor.
Line 56, Delete “doorjamb” and insert -- door jamb --, therefor.
Line 62, Delete “doorjamb.” and insert -- door jamb. --, therefor.

Column 10
Line 39, Delete “"Dyna” and insert -- "Dyne --, therefor.

Signed and Sealed this
Eighteenth Day of June, 2013

Teresa Stanek Rea
*Acting Director of the United States Patent and Trademark Office*